United States Patent [19]

DuBois et al.

[11] 4,013,359

[45] Mar. 22, 1977

[54] ELECTROSTATIC COPIER INCLUDING MEANS FOR DETACHING PAPER FROM A PHOTOCONDUCTOR

[75] Inventors: Robert Clark DuBois, Fairfield; Eugene Patrick Lavin, Stratford; Joseph F. Miciukiewicz, Trumbull, all of Conn.

[73] Assignee: Pitney-Bowes, Inc., Stamford, Conn.

[22] Filed: Aug. 23, 1974

[21] Appl. No.: 500,048

[52] U.S. Cl. ..... 355/16; 271/DIG. 2; 355/3 R

[51] Int. Cl.[2] ..... G03G 15/00

[58] Field of Search ..... 355/16, 14, 3 R; 271/DIG. 2, 80, 174, 277

[56] References Cited

UNITED STATES PATENTS

| | | | |
|---|---|---|---|
| 2,684,902 | 7/1954 | Mayo et al. | 118/637 |
| 3,196,767 | 7/1965 | Eichorn | 271/277 X |
| 3,409,356 | 11/1968 | Robertson et al. | 355/3 R |
| 3,506,259 | 4/1970 | Caldwell et al. | 355/3 R |
| 3,567,213 | 3/1971 | Lagonegro et al. | 271/277 X |
| 3,578,859 | 5/1971 | Stillings | 271/DIG. 2 |
| 3,620,615 | 11/1971 | Volkers | 355/3 R |
| 3,649,115 | 3/1972 | Hodges | 355/16 X |
| 3,684,363 | 8/1972 | Ito et al. | 355/3 R |
| 3,695,756 | 10/1972 | Smith | 355/3 R |
| 3,746,442 | 7/1973 | Davidson | 355/3 R |
| 3,811,670 | 5/1974 | Inoue | 271/DIG. 2 |
| 3,820,778 | 6/1974 | Veillard | 271/DIG. 2 |
| 3,895,793 | 7/1975 | Bigenwald | 271/DIG. 2 |

*Primary Examiner*—R. L. Moses
*Attorney, Agent, or Firm*—Donald P. Walker; Albert W. Scribner; Martin D. Wittstein

[57] ABSTRACT

In combination with paper conveying apparatus in an electrostatic copier, including a movable photoconductor adapted to be electrically energized from a source of supply of electrostatic charge for attaching thereto a sheet of paper for movement therewith, there is described structure for detaching the sheet from the moving photoconductor. The structure includes the provision of one or more apertures in the photoconductor and finger means movable at least partially through the apertures, as the photoconductor is moving, for urging a portion of the attached sheet of paper away from the photoconductor. In addition, the structure preferably includes vacuum header means for urging the remainder of the attached sheet of paper away from the moving photoconductor.

9 Claims, 2 Drawing Figures

ELECTROSTATIC COPIER INCLUDING MEANS FOR DETACHING PAPER FROM A PHOTOCONDUCTOR

BACKGROUND OF THE INVENTION

Electrostatic copying machines or copiers of the type which perform processes wherein an electrostatic latent image formed on a moving photodconductor is developed by contacting the same with a dry developer material, and wherein the developed image is subsequently transferred from the photoconductor to a suitable sheet of paper by contacting the photoconductor with the sheet of paper, are generally provided with paper handling apparatus including means for detaching the sheet of paper from the moving photoconductor before further processing, since the sheet of paper is normally relatively securely held in place on the photoconductor by residual electrostatic charge.

In one known copier there has been provided paper handling apparatus including a pressure header in air flow communication with a plurality of intermittently operable jet-type air outlet nozzles for detaching sheets of paper from the moving photoconductor. The nozzles are suitably shaped and located adjacent to the photoconductor, and operable in timed relationship with movement of the photoconductor, to direct blasts of air toward the boundary between the leading edge of the elctrostatically attached sheet of paper and the photoconductor surface, for dislodging the sheet of paper from the moving photoconductor. Such arrangements of apparatus tend to be expensive in design and execution because the developed image on the sheet of paper is relatively easily movable and thus subject to becoming deteriorated by the air blasts.

In another known copier there has been provided paper handling apparatus including a plurality of pick-off fingers, operable in timed relationship with the movement of the moving photoconductor. The pick-off fingers are slid between the leading edge of the electrostatically attached sheet of paper and the adjacent area of the photoconductor surface to disengage the paper from the photoconductor. In addition to copying with the problem of avoiding movement of the developed image on the sheet of paper, such arrangements must be carefully designed to avoid having the pick-off fingers contact the photoconductor surface with sufficient force to score or otherwise damage the surface.

Accordingly, an object of the present invention is to provide improved apparatus for handling a sheet of paper in a copier;

Another object is to provide apparatus for detaching a sheet of paper from an electrostatically charged surface; and Another object is to provide apparatus for handling a sheet of paper in a copier including improved means for detaching the sheet of paper from a moving photoconductor to which it is attached by electrostatic charge.

SUMMARY OF THE INVENTION

In combination with paper conveying means in an electrostatic copier, including a movable plate-type photoconductor adapted to be sufficiently electrostatically charged to attach a sheet of paper to the photoconductor for movement therewith, the invention includes apparatus for detaching the sheet of paper from the moving photoconductor. The apparatus includes the provision of one or more apertures in the photoconductor, and finger means insertable at least partially through the aperture or apertures, as the case may be, for urging a portion of the attached sheet of paper away from the moving photoconductor. In addition, it is a feature of the invention to provide vacuum header means for urging the remainder of the attached sheet of paper away from the moving photoconductor.

BRIEF DESCRIPTION OF THE DRAWINGS

As shown in the drawings, wherein like reference numerals designate like or corresponding parts throughout the several figures.

DESCRIPTION OF THE PREFERRED EMBODIMENTS

Figure 1:
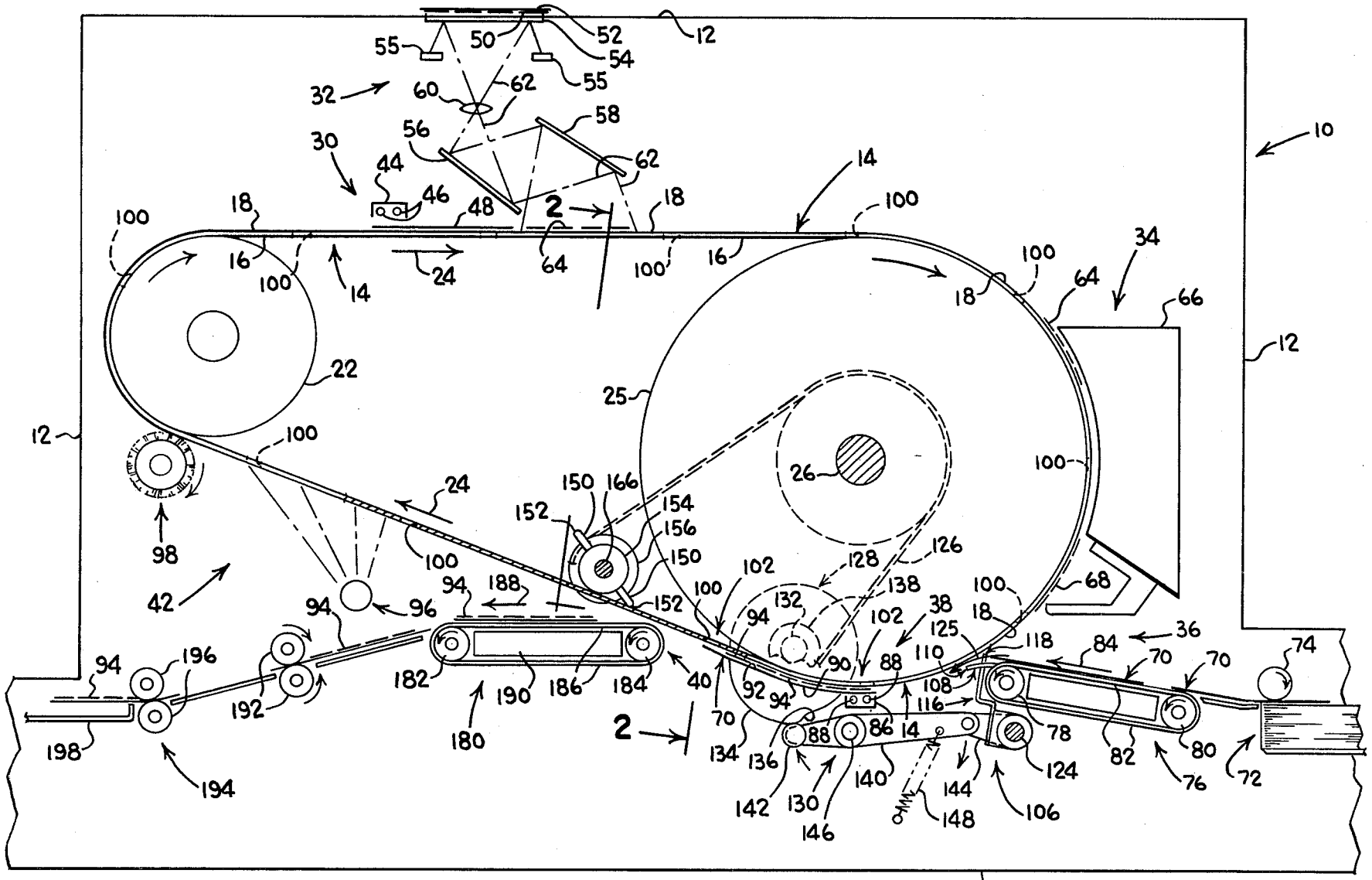
FIG. 1 is a schematic view of an electrostatic copier having a movable plate-type photoconductor, and including apparatus for detaching a sheet of paper from the moving photoconductor in accordance with the invention.

As shown in FIG. 1, an electrostatic copier 10, of the type which may be improved in accordance with the present invention, generally includes suitable framework 12 for supporting the various components of the copier 10, including a suitable photoconductor 14 adapted to carry an electrostatic charge thereon. Although the photoconductor 14 may include any well-known plate-type structure including an inflexible shell or flexible strip of substratum material, impregnated or coated with any type of photoconductive material, without departing from the spirit and scope of the invention, a strip-type photoconductor 14 is shown herein since it is preferably used in a copier 10 which is improved in accordance with the present invention. The photoconductor 14 is made of a suitable strip of relatively stiff but flexible material, and has an inner surface 16 and an outer surface 18. The outer surface 18 is coated with a suitable photoconductive material such as selenium.

To movably support the photoconductor 14 (FIG. 1) within the copier 10, the copier 10 includes one or more elongated rotatable idler shafts 22, about which the photoconductor 14 is suitably endlessly looped. The shaft 22 is suitably secured to the framework 12 so as to longitudinally extend transverse to a desired direction of travel 24 of the photoconductor 14. For moving the photoconductor 14, the copier 10 includes, for example, a suitably elongated rotatable drum 25 about which the photoconductor 14 is additionally looped. The drum 25 has a driven shaft 26 suitably secured to the framework 12 so as to extend parallel to the aforesaid one or more shafts 22, and the drum 25 is provided with suitable well-known means for rotating the same in nonslipping engagement with the photoconductor 14, for moving the photoconductor 14 in the aforesaid direction of travel 24 through a charging station 30, imaging station 32, developing station 34, paper feeding station 36, image transferring station 38, paper detaching station 40 and cleaning station 42.

At the charging station 30 (FIG. 1), the copier 10 includes a suitably electrically energizable corona charging device 44 including, for example, a pair of elongated, high-voltage electrodes 46 suitably spaced from the moving photoconductor 14 and oriented so as to longitudinally extend transverse to the photoconductor's direction of travel 24 for depositing a uniformly distributed array of electrostatic charges 48 of suitable polarity on the photoconductor's outer surface 18 for imaging purposes.

At the imaging station 32 (FIG. 1), the copier 10 includes suitable means for providing the photoconductor 14 with information in the form of a graphic image 50 carried by a document 52 placed by the operator on a glass platen 54 secured to the copier's framework 12. To that end, the copier 10 includes, for example, one or more electrically energizable light sources 55, reflectors 56 and 58 and an optical lens 60; each of which is adapted by wellknown means to cooperate with the other for illuminating the document 52 and flash exposing the outer surface 18 of the photoconductor 14 with light 62 modulated by the graphic image 50. The graphic-image modulated light 62 from the reflectors 56 and 58 causes the photoconductor 14 to conduct and dissipate sufficient charge 48 from the photoconductor's outer surface 18 to provide the same with an electrostatic latent image 64 for development purposes.

At the developing station 34 (FIG. 1), the copier 10 includes suitable means for applying toner material (not shown) to the image 64 including, for example, a cascade or magnetic brush applicator assembly 66 of the type which is well-known in the art for applying toner material to the image-bearing outer surface 18 of the photoconductor 14. The applied toner material adheres to the electrostatic latent image 64 for developing the same, thereby forming a visible image 68 on the outer surface 18 of the moving photoconductor 14 for transfer to a sheet of paper 70 fed thereto.

At the paper feeding station 36 (FIG. 1), the copier 10 includes suitable means for feeding a sheet of paper 70, from a suitably supported paper stack 72, into contact with the developed image 68 on the photoconductor's outer surface 18. The feeding means includes, for example, a suitably driven roller 74 and transporting device 76; the latter including a suitably driven roller 78 and an idler roller 80, and a belt 82 endlessly looped around the rollers 78 and 80. The rollers 74, 78 and 80 extend parallel to one another and transverse to a desired direction of travel 84 of a sheet of paper 70. Roller 74 is suitably secured to the framework 12 for rotation in engagement with the topmost sheet of paper 70 in the paper stack 72, for feeding the engaged sheet of paper 70 to the belt 82. And, rollers 78 and 80 are suitably secured to the framework 12 for rotation in engagement with the belt 82 for movement thereof. The belt 82 carries a sheet of paper 70 fed to the same from the stack 72, in the aforesaid desired direction of travel 84 and into surface contact with the moving photoconductor 14, for transferring the developed image 68 from the photoconductor 14 to the sheet of paper 70.

At the image transferring station 38, the copier 10 includes suitable means for transferring the developed image 68 to a sheet of paper 70 such a roller (not shown) for forcing a sheet of paper 70 received from the belt 82 into intimate engagement with the photoconductor's outer surface 18, or a suitably electrically energizable corona charging device 86. The charging device 86 is shown herein since it is preferably used in a copier 10 which is improved in accordance with the present invention. The charging device 86 includes a pair of elongagted, high-voltage electrodes 88, suitably spaced from the moving photoconductor 14 and oriented so as to extend transverse to the photoconductor's direction of travel 24. The electrodes 88 are adpated by well-known means to deposit a uniformly distributed array of electrostatic charges (not shown) of suitable polarity on the surface 90 of the sheet of paper 70 disposed out of contact with the photoconductor 14, to promote transferring the developed image 68 from the photoconductor's outer surface 18 to the surface 92 of the sheet of paper 70 disposed in contact with the photoconductor 14.

At the paper detaching station 40, the attached sheet of paper 70, now bearing a transferred developed image 94, is separated from the photoconductor's outer surface 18 as the moving photoconductor 14 advances to the cleaning station 42, where the copier 10 is provided with suitable cleaning apparatus including, for example, a lamp 96 and a suitably housed and driven rotating brush 98. The lamp 96 is secured to the copier framework 12 and disposed in sufficiently close proximity to the photoconductor's outer surface 18 to irradiate the photoconductive coating thereon in order to remove any residual charge 48 from the coating. And, the brush 98 is suitably secured to the framework 12 so as to longitudinally extend transverse to the direction of travel 24 of the moving photoconductor 14 and rotate in engagement with the same for removing any toner material from the photoconductor 14 which was not transferred therefrom to the sheet of paper 70. The cleaned photoconductor 14 is thereafter returned to the charging station 30.

Figure 2:
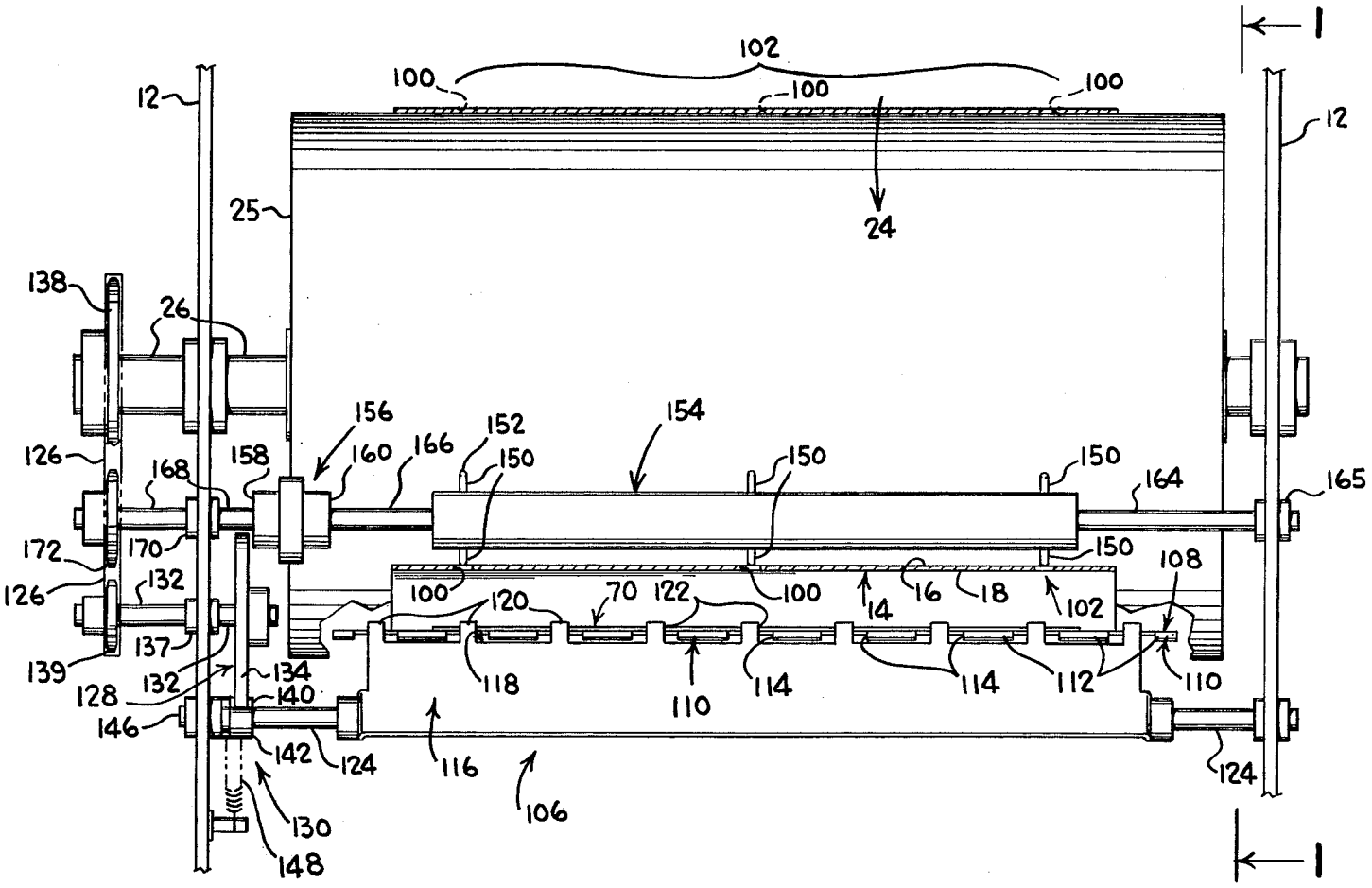
FIG. 2 is a fragmentary cross-sectional view of the copier of FIG. 1, taken substantially along the line 2—2 thereof, showing the paper detaching apparatus in greater detail.

According to the present invention, the copier 10 (FIG. 1) is provided with apparatus for detaching a sheet of paper 70 from the moving photoconductor 14 including at least one aperture 100 (FIGS. 1 and 2) formed in the photoconductor 14. Depending on its length, the photoconductor 14 preferably includes one or more rows 102 (FIG. 2) of apertures 100, with each row 102 including a plurality of apertures 100. The apertures 100 of a given row 102 are located at equidistantly spaced intervals along a line extending transverse to the direction of travel 24 of the moving photoconductor 14, and each of the rows 102 is equidistantly spaced from the next adjacent row 102 in the aforesaid direction of travel 24.

It is a feature of the invention to also provide suitable means for feeding a sheet of paper (FIG. 1) into contact with the photoconductor's outer surface 18 so as to ensure electrostatic attachment of the sheet of paper 70 in overlapping relationship with the apertures 100 of a given aperture row 102. To that end the copier 10 includes paper gating apparatus 107 (FIGS. 1 and 2) operable in timed relationship with movement of the photoconductor 14.

The gating apparatus 106 (FIGS. 1 and 2) includes an elongated guide plate 108 having a curved transverse cross-section. The guide plate 108 has a forwardly extending edge 110 formed by a plurality of alternate ridges 112 (FIG. 2) and grooves 114. And, the plate 108 is suitably fixedly secured to the copier framework 12, adjacent to the paper transporting device 76 (FIG. 1) for directing sheets of paper 70 fed from the paper transporting belt 82 into approximately tangential contact with the photoconductor's outer surface 18. The gating apparatus 106 (FIGS. 1 and 2) also includes an elongated barrier plate 116 having a generally step-shaped transverse cross-section. The barrier plate 116 has a forwardly extending edge 118 formed by a plurality of alternate ridges 120 (FIG. 2) and grooves 122 dimensioned to respectively intermesh with the grooves 114 and ridges 112 of the guide plate 108. The barrier plate 116 is suitably pivotally attached to the copier framework 12, as by means of a pivot shaft 124 disposed adjacent to and below the guide plate 108 for moving the ridges 120 of the barrier plate 116 in an arcuate path of travel 125 (FIG. 1) in and out of the grooves 114 (FIG. 2) of the guide plate 108. The arcuate path of travel 125 of the barrier plate ridges 120 intersects the path of travel of a moving sheet of paper 70 at the forward edge 110 of guide plate 108. Accordingly, the barrier plate 116 is movable relative to the guide plate 108 for alternately stopping and releasing a sheet of paper 70 on the guide plate 108 as it is being fed to the photoconductor 14 by the paper transporting belt 82.

To operate the gating apparatus 106 (FIG. 1) the copier 10 includes a belt 126, cam 128 and cam-follower apparatus 130. The cam 128 includes a cam shaft 132 and has a circumferentially-extending cam surface 134, the latter having an interdental groove 136 formed therein. The cam shaft 132 (FIG. 2) is suitably movably attached to the copier framework 12, as by means of a bearing 137, for rotation about an axis extending parallel the axis of rotation of the photoconductor drive shaft 26. The belt 126 is endlessly looped around a pair of pulleys 138 and 139 respectively mounted on the photoconductor drive shaft 26 and cam shaft 132, for rotating the cam shaft 132 in step with the rotation of the drive shaft 26. To ensure rotation of the respective shafts 26 and 132 in step with one another, the pulleys 138 and 139 and belt 126 are respectively provided with suitable means such as a plurality of ridges and grooves (not shown) dimensioned to intermesh with one another to prevent slippage therebetween. Since the drive shaft 26 and photoconductor 14 are also provided with suitable means (not shown) to prevent slippage therebetween, the cam surface's interdental groove 136 (FIG. 1) may be arranged to move in timed relationship with any given row 102 photoconductor apertures 100, by suitably locating the shafts 26 and 132, and thus the cam groove 136 and given aperture row 102, relative to one another before mounting the belt 126 on the pulleys 138 and 139. The cam-follower apparatus 130 includes an elongated arm 140. The arm 140 has a roller 142 suitably movably attached to one of the ends thereof and has a bracket 144 pivoted to the other end thereof which is rigidly attached to the pivot shaft 124 of the barrier plate 116. The arm 140 is suitably pivotably attached to the copier framework 12 approximately midway between the ends thereof, as by means of a pivot shaft 146, for pivotal movement about an axis extending parallel to both the axis of rotation of the cam shaft 132 and the pivot axis of the barrier plate pivot shaft 124. The cam-follower apparatus 130 also includes an elongated circularly-helically coiled spring 148 having one end suitably attached to the cam-follower arm 140 and the other end suitably attached to the copier framework 12 to hold roller 142 of the arm 140 in rolling engagement with the cam surface 134. As the cam surface 134 rotates in engagement with the cam-follower roller 142, it does not pivot the arm 140 until such time as the roller 142 is urged into the cam groove 136 by means of the follower spring 148. Whereupon the follower arm 140, pivoting about its axis, moves the follower bracket 144 pivoted thereto, to move the barrier plate 116 away from the guide plate 108, thereby releasing a sheet of paper 70. As the cam-follower roller 142 moves out of the cam groove 136, the arm 140 moves the barrier plate 116 toward the guide plate 108 to stop a subsequently delivered sheet of paper 70. Since the cam groove 136 can be arranged to move in timed relationship with a given row 102 of photoconductor apertures 100, as hereinbefore discussed, the relative movement of the cam groove 136 and given aperture row 102 may be arranged such that a sheet of paper 70 is timely released by the barrier plate 116 to permit the same to contact the photoconductor surface 18 in overlapping relationship with a given row 102 of apertures 100. Accordingly, the belt 126, cam 128 and cam-follower apparatus 130 are adapted to cooperate with one another and with the photoconductor drive shaft 26 and the barrier plate 116 of the gating apparatus 106, for moving the barrier plate 116 in timed relationship with movement of a given row 102 of photoconductor apertures to ensure electrostatic attachment of a sheet of paper 70 in overlapping relationship with one or more photoconductor apertures 100.

In addition to providing at least one aperture 100 in the photoconductor 14, the paper detaching apparatus includes at least a like number of finger members 150 (FIGS. 1 and 2), each of which is associated with a different aperture 100; and includes apparatus for moving the finger members 150 at least partially through the apertures 100 in a given aperture row 102 to urge a portion of an attached sheet of paper 70 away from the moving photoconductor 14. Each of the finger members 150 (FIG. 2) is an elongated rod having a rounded end 152. The apparatus for moving the finger members 150 includes an elongated rotatable drive shaft 154, a slip clutch 156 having a driving side 158 and a driven side 160, and the belt 126. The finger members 150 are arranged in two rows thereof which extend in opposite directions from the drive shaft 154. The shaft 154 has one end suitably rotatably attached to the copier framework 12, as by means of a stub shaft 164 and bearing 165, and the other end suitably attached to the driven side 160 of the slip clutch 156, as by means of a stub shaft 166. The driving side 158 of the slip clutch 156 is in turn suitably rotatably attached to the copier framework 12, as by means of a shaft 168 and bearing 170. As thus attached to the copier framework 12 in series with the slip clutch 156, the shaft 154 longitudinally extends transverse to the direction of travel 24 of the moving photoconductor 14 and is sidewise disposed sufficiently adjacent to the photoconductor 14 to permit the finger members 150 to be rotated by the drive shaft 154 in an arcuate path of travel into and out of the apertures 100 of each of the aperture rows 102. To rotate the drive shaft 154, the apparatus for moving the finger members 150 also includes a pulley 172 suitably rigidly mounted on shaft 168. The belt 126 is endlessly looped around pulley 172 and the drive shaft pulley 138 to rotate the finger members 150 within the apertures 100 in the direction of movement of the photoconductor 14. Preferably, the pulley 172, like pulleys 138 and 139 and the belt 126, is provided with suitable means such as a plurality of alternate ridges and grooves (not shown) dimensioned to intermesh with the belt 126 to prevent slippage between the rotating pulleys 138 and 172. And, the pulleys 138 and 172 are dimensioned to ensure rotation of the shaft 154 at a speed which ensures that there is minimal relative movement, in the direction of movement of the photoconductor 14, between the rounded ends 152 of the finger members 150 and the photoconductor 14 when the finger members 150 are moving within the photoconductor apertures 100. As a result, a sheet of paper 70 (FIG. 1) disposed in overlapping relationship with the row 102 of apertures 100 through which the finger members 150 are inserted is pushed away from the photoconductor 14 without deteriorating the developed image 94 on the sheet of paper 70.

As the shaft 154 (FIG. 1) is rotated, the finger members 150 rotate into contact with the photoconductor's inner surface 16, between the adjacent aperture rows 102, causing the driven side 160 (FIG. 1) of the slip clutch 156 to slip relative to the driving side 158 of the same. As a result, the shaft 154 stops rotating, although pulley 172 continues to be rotated by the belt 126. When the photoconductor 14 (FIG. 1) carries a given row 102 of apertures 100 into registry with the finger members 150, since the finger members 150 then no longer bear against the photoconductor 14 the driven side 160 (FIG. 2) of the clutch 156 stops slipping and commences rotating. As a consequence, the shaft 154 is again rotated by pulley 172 to move the finger members 150 in an arcuate path of travel into and out of the apertures 100. Since the finger members 150 (FIG. 1) are thereby inserted at least partially through the aperture row 102 in registry therewith, the marginal edge portion of a sheet of paper 70 which overlaps that particular row 102 of apertures 100 will be pushed away from the moving photoconductor 14 by the inserted finger members 150. Accordingly, the finger members 150 are insertable through the apertures 100 for urging a portion of an electrostatically attached sheet of paper 70 away from the moving photoconductor 14.

To thereafter urge the remainder of the attached sheet of paper 70 away from the moving photoconductor 14 a variety of well-known prior art devices may be used. However, it is a feature of the invention that the paper detaching apparatus further include a paper transporting device 180 (FIG: 1).

The paper transporting device 180 includes a suitably driven roller 182 and an idler roller 184, and a perforated belt 186 endlessly looped around rollers 182 and 184. The rollers 182 and 184 extend parallel to one another, transverse to the path of travel the moving photoconductor 14 and transverse to a desired path of travel of a sheet of paper 70 attached to the photoconductor 14. In addition, the transporting device 70 includes a suitably apertured vacuum header 190 disposed between the rollers 182 and 184, and thus within the loop of the belt 186, for drawing air through the perforations (not shown) of the belt 186. The transporting device 180 is located sufficiently close to the photoconductor 14 to permit the finger members 150 to push the marginal portion of a sheet of paper 70 substantially into surface contact with the perforated belt 186. As a result, the vacuum header 190 draws the detached marginal portion of the sheet of paper 70 into engagement with the belt 186 for movement therewith. Rollers 182 and 184 are suitably secured to the copier framework 12 for rotation in engagement with the belt 186 for moving the belt 186 at a suitable speed relative to that of the photoconductor 14 to permit the belt 186 to strip the remaining portion of the moving sheet of paper 70 from the photoconductor 14 without deteriorating the transferred image 94 on the same. The belt 186 carries the sheet of paper 70 fed to the same from the photoconductor 14 along the aforesaid desired path of travel away from the photoconductor 14. Thus the vacuum header 190 and moving belt 186 cooperate with one another for urging the remainder of the attached sheet of paper 70 away from the moving photoconductor 14.

After the sheet of paper 70 (FIG. 1) is detached from the moving photoconductor 14 and moved away from the same, the transferred developed image 94 is fused to the paper 70 through the application of heat to the image 94. To that end, the copier 10 includes an image bonding device such as a pair of suitably heated elongated roller 192. The rollers 192 are disposed parallel to one another and suitably secured to the copier framework 12 so as to longitudinally extend transverse to the path of travel of the moving image-bearing sheet of paper 70. The rollers 192 are also suitably driven by well-known means in engagement with the sheet of paper 70 for feeding the bonded-image bearing paper 70 to a receiving station 194. At the receiving station 194, the copier 10 includes a pair of suitably driven paper feeding rollers 196 adapted by well-known means to engage and feed sheets of paper 70 to a suitable hopper 198 for retrieval by the operator of the copier 10.

In accordance with the objects of the inventin, there has been described improved apparatus for handling a sheet of paper in a copier, including apparatus for detaching a sheet of paper from a moving photoconductor to which the paper is attached by means of electrostatic charge.

Inasmuch as certain changes may be made in the above described invention wihout departing from the spirit and scope of the same, it is intended that all matter contained in the above description or shown in the accompanying drawings shall be interpreted in an illustrative rather than limiting sense. And, it is intended that the following claims be interpreted to cover all the generic and specific features of the invention herein described.

What is claimed is:

1. In a copier including means for supplying electrostatic charge, apparatus for handling a sheet of paper comprising:

a. paper conveying means including a movable plate-type photoconductor adapted to be sufficiently electrically energized from said charge supplying means for electrostatically attaching the sheet of paper to the photoconductor for movement therewith;

b. means for detaching the attached sheet of paper from the moving photoconductor, said detaching means including at least one aperture formed in the photoconductor and finger means insertable at least partially through said at least one aperture for urging a portion of the attached sheet of paper away from said moving photoconductor and said detaching means including means for moving the inserted finger means in the direction of movement of said photoconductor.

2. The apparatus according to claim 1 including said photoconductor being an endless strip-type photoconductor adapted to be uniformly electrostatically charged from said charge supplying means and to receive light for forming thereon an electrostatic latent image, and the charge forming said latent image being sufficient to attach the sheet of paper to said moving photoconductor.

3. The apparatus according to claim 1 including means for feeding the sheet of paper into contact with said moving photoconductor so as to ensure electrostatic attachment of the sheet of paper to said photoconductor in overlapping relationship with said at least one aperture.

4. The apparatus according to claim 1 wherein the detaching means includes means for retaining the detached portion of the sheet of paper out of contact with the moving photoconductor.

5. In a copier including means for supplying electrostatic charge, apparatus for handling a sheet of paper comprising:

a. paper conveying means including a movable plate-type photoconductor adapted to be sufficiently electrically energized from said charge supplying means for electrostatically attaching the sheet of paper to the photoconductor for movement therewith;

b. means for detaching the attached sheet of paper from the moving photoconductor, said detaching means including at least one aperture formed in the photoconductor and finger means insertable at least partially through said at least one aperture for urging a portion of the attached sheet of paper away from said moving photoconductor; and c. said conveying means including means for moving said photoconductor in a predetermined path of travel, said detaching means including a rotatable shaft extending transverse to the path of travel of the moving photoconductor, and said finger means extending sidewise from said shaft for rotation therewith, whereby said finger means move in an arcuate path of travel into and out of said at least one aperture and move in the direction of the path of travel of the moving photoconductor within said at least one aperture.

6. In a copier including means for supplying electrostatic charge, apparatus for handling a sheet of paper having an image bearing surface comprising:

a. paper conveying means including a movable plate-type photoconductor adapted to be sufficiently electrically energized from said charge supplying means for electrostatically attaching the sheet of paper to the photoconductor for movement therewith; and b. means for detaching the attached sheet of paper from the moving photoconductor, said detaching means including at least one aperture formed in the photoconductor and finger means insertable at least partially through said at least one aperture and into contact with the image bearing surface of said paper for urging a portion of the attached sheet of paper away from said moving photoconductor, and said detaching means including vacuum header means for urging the remaining portion of the attached sheet of paper away from said moving photoconductor.

7. In a copier including means for supplying electrostatic charge, apparatus for handling a sheet of paper having an image bearing surface comprising:

a. paper conveying means including a movable plate-type photoconductor adapted to be sufficiently electrically energized from said charge supplying means for electrostatically attaching the sheet of paper to the photoconductor for movement therewith; and b. means for detaching the attached sheet of paper from the moving photoconductor, said detaching means including at least one aperture formed in the photoconductor and finger means insertable at least partially through said at least one aperture and into contact with the image bearing surface for urging a portion of the attached sheet of paper away from said moving photoconductor, and said detaching means including a movable perforated belt and a vacuum header cooperating with the perforated belt for urging the remaining portion of the attached sheet of paper away from said moving photoconductor.

8. In a copier including means for supplying electrostatic charge, apparatus for handling a sheet of paper comprising:

a. paper conveying means including a movable plate-type photoconductor adapted to be sufficiently electrically energized from said charge supplying means for electrostatically attaching the sheet of paper to the photoconductor for movement therewith; and b. means for detaching the attached sheet of paper from the moving photoconductor, said detaching means including at least one aperture formed in the photoconductor and finger means insertable at least partially through said at least one aperture for urging a portion of the attached sheet of paper away from said moving photoconductor, said detaching means including a rotatable shaft for moving said finger means in an arcuate path of travel within said at least one aperture, said detaching means including means for rotating said shaft, and said shaft rotating means including a slip clutch through which rotational movement is imparted to said shaft.

9. In a copier including means for supplying electrostatic charge, apparatus for handling a sheet of paper comprising:

a. paper conveying means including a movable plate-type photoconductor adapted to be sufficiently electrically energized from said charge supplying means for electrostatically attaching the sheet of paper to the photoconductor for movement therewith; and b. means for detaching the attached sheet of paper from the moving photoconductor, said detaching means including at least one aperture formed in the photoconductor and finger means insertable at least partially through said at least one aperture for urging a portion of the attached sheet of paper away from said moving photoconductor, and said detaching means including means for moving said finger means within said at least one aperture in the direction of movement of said moving photoconductor and at substantially the same velocity as the photoconductor in said direction of movement thereof.

* * * * *

UNITED STATES PATENT AND TRADEMARK OFFICE

CERTIFICATE OF CORRECTION

PATENT NO. : 4,013,359

DATED : March 22, 1977

INVENTOR(S) : Robert Clark DuBois, Eugene Patrick Lavin and Joseph F. Miciukiewicz It is certified that error appears in the above-identified patent and that said Letters Patent are hereby corrected as shown below:

In column 1, line 43, please change "copying" to --coping--;

in column 4, line 1, please change "elongagted" to --elongated--;

in column 4, lines 4 and 5, please change "ad-pated" to --adapted--;

in column 4, line 53, please change "107" to --106--;

in column 8, line 14, please change "roller" to --rollers--;

in column 8, line 27, please change "inventin" to --invention--;

in column 8, line 68, please change ", and" to --;--; and in column 10, line 12, please insert --of said paper-- after the word "surface"

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*